US005898151A

United States Patent [19]

Plat et al.

[11] Patent Number: 5,898,151

[45] Date of Patent: Apr. 27, 1999

[54] CIRCUIT-BREAKER WITH A DISCONNECTOR

[75] Inventors: Jean-Michel Plat, Estrablin; Jean-Marc Willieme, La Mulatiere, both of France

[73] Assignee: GEC Alsthom T & D SA, Paris, France

[21] Appl. No.: 09/072,688

[22] Filed: May 6, 1998

[30] Foreign Application Priority Data

May 7, 1997 [FR] France ..... 97 05639

[51] Int. Cl.[6] ..... H01H 33/04

[52] U.S. Cl. ..... 218/84; 218/140; 218/14

[58] Field of Search ..... 218/1, 4, 7, 9, 218/14, 11, 12, 13, 16, 17, 18, 19, 43, 44, 48, 50, 74, 78, 84, 92, 107, 108, 140

[56] References Cited

U.S. PATENT DOCUMENTS

| | | | |
|---|---|---|---|
| 3,399,286 | 8/1968 | Kerr, Jr. . | |
| 3,646,292 | 2/1972 | Barkan et al. | 218/43 |
| 5,495,084 | 2/1996 | Meyer et al. | 218/43 |
| 5,561,280 | 10/1996 | Blatter | 218/59 |

FOREIGN PATENT DOCUMENTS

| | | |
|---|---|---|
| 0412479A1 | 2/1991 | European Pat. Off. . |
| 2189916 | 1/1978 | France . |
| 3407858A1 | 8/1984 | Germany . |

*Primary Examiner*—Lincoln Donovan
*Attorney, Agent, or Firm*—Sughrue, Mion, Zinn Macpeak & Seas, PLLC

[57] ABSTRACT

A circuit-breaker including main contacts and arcing contacts includes a shaft carrying a first lever connected to the moving main contact. A hub is mounted inside the shaft and carries a second lever connected to the moving arcing contact; the shaft and the hub being shaped over a certain portion into two sectors between which a spring is disposed. A single control causes the shaft to rotate so that the shaft firstly causes the hub to rotate via the spring, the shaft and the hub rotating respectively causing the moving main contact and the moving arcing contact to move, and the shaft secondly rotates to a further extent, with the hub being prevented from rotating by action from an abutment. This arrangement makes it possible to implement a simple synchronization of the main contacts opening before the arcing contacts.

4 Claims, 3 Drawing Sheets

CIRCUIT-BREAKER WITH A DISCONNECTOR

The invention relates to a generator circuit-breaker comprising a stationary tubular main contact and a moving tubular main contact mounted to move relative to the stationary tubular main contact in a "longitudinal" direction, the main contacts defining an internal volume inside which a vacuum or gas "bottle" is disposed having a stationary arcing contact and a moving arcing contact mounted to move relative to the stationary arcing contact in said longitudinal direction, synchronization means ensuring that the main contacts separate before the arcing contacts separate.

BACKGROUND OF THE INVENTION

Such a circuit-breaker is usually placed between a generator of an electrical power plant and a transformer connected to a power line.

In known manner, the main contacts are heavy enough to withstand high nominal currents without overheating. They define a relatively large volume which is more difficult to put under gas pressure or under a vacuum than is a "bottle" of smaller size disposed inside said volume. Such a bottle is provided with a stationary arcing contact and a moving arcing contact which are less heavy because they withstand only the cutoff current of the circuit-breaker.

In Patent Application FR 89 13279, the moving main contact and the moving arcing contact extend in the same longitudinal direction, so they are moved in translation parallel to that direction, by pneumatic piston-and-cylinder means.

Such means have drawbacks.

Firstly, it is necessary to provide electrically-driven valves for synchronizing the movements of the pneumatic actuators of the moving main contact and of the moving arcing contact. In particular, the moving main contact must move far enough to be able to withstand a transient voltage before the moving arcing contact opens.

Secondly, at the end of the stroke of the moving arcing contact, it is possible to obtain satisfactory acceleration, enabling the circuit-breaker to be opened more effectively, only with rather sophisticated apparatus for feeding the pneumatic actuators with gas.

OBJECTS AND SUMMARY OF THE INVENTION

An object of the invention is to provide a generator circuit-breaker in which the moving main contact and the moving arcing contact are actuated by a limited number of mechanical means that can be synchronized simply.

To this end, the invention provides a generator circuit-breaker comprising a stationary tubular main contact and a moving tubular main contact mounted to move relative to the stationary tubular main contact in a "longitudinal" direction, the main contacts defining an internal volume inside which a vacuum or gas "bottle" is disposed having a stationary arcing contact and a moving arcing contact mounted to move relative to the stationary arcing contact in said longitudinal direction, and synchronization means ensuring that the main contacts separate before the arcing contacts separate, wherein the synchronization means comprise a shaft extending transversely to the longitudinal direction and carrying a first lever connected to the moving main contact, and a hub which is mounted inside the shaft and which carries a second lever connected to the moving arcing contact, the shaft and the hub being shaped over a certain portion into two sectors between which a spring is disposed, the levers forming an angle in a plane extending transversely to the shaft, the shaft firstly rotating to an initial extent, thereby moving the moving main contact and rotating the hub via the spring, the hub thereby moving the moving arcing contact, and secondly rotating to a further extent, with the hub being prevented from rotating by action from an abutment.

By constraining the shaft and the hub to rotate together by means of a spring, it is possible to move the moving contacts in translation using single mechanical control means.

The movement of the moving main contact is synchronized relative to the movement of the moving arcing contact merely by means of two levers that form an angle in a plane extending transversely to the shaft, the lengths of the levers being in a certain ratio to each other.

On circuit-breaker opening, the moving main contact, which is relatively heavy, moves at a substantially constant speed, thereby making it possible to minimize the power required by the mechanical control means. At first, the moving arcing contact moves more slowly than the main contact, thereby enabling the main contact to travel a distance that is long enough to be able to withstand a transient voltage before the arcing contacts open. Then the moving arcing contact moves more rapidly than the moving main contact, thereby making it possible to reduce the length of time for which the arcing contacts are exposed to the cutoff current.

The generator further comprises a disconnector having a moving contact rod mounted to move in said longitudinal direction relative to a ring of contact fingers that are secured to the vacuum or gas bottle.

The disconnector has no interrupting capability, and it must open only once the arcing contact is open. Advantageously, the generator circuit-breaker of the invention makes it possible to move and to synchronize the moving contact of the disconnector by means of a limited number of additional means relative to the means already implemented to move and synchronize the moving main contact and the moving arcing contact.

In an embodiment of the invention, the generator circuit-breaker further comprises a disconnector having a moving contact rod mounted to move in said longitudinal direction relative to a ring of contact fingers that are secured to the vacuum or gas bottle, in which circuit-breaker the contact rod is connected to the shaft via a linkage.

Synchronizing the movement of the contact rod relative to the moving contacts is achieved simply by means of the shaft and the linkage co-operating, thereby making it possible to open the disconnector once firstly the moving main contact has travelled over a stroke that is long enough to withstand a transient voltage, and secondly once the moving arcing contact has travelled over a sufficiently long dielectric strength stroke.

BRIEF DESCRIPTION OF THE DRAWINGS

Other characteristics and advantages of the invention appear on reading the following description of two embodiments shown in FIGS. 1 to 3, in which.

DETAILED DESCRIPTION OF THE PREFERRED EMBODIMENT

Figure 1:
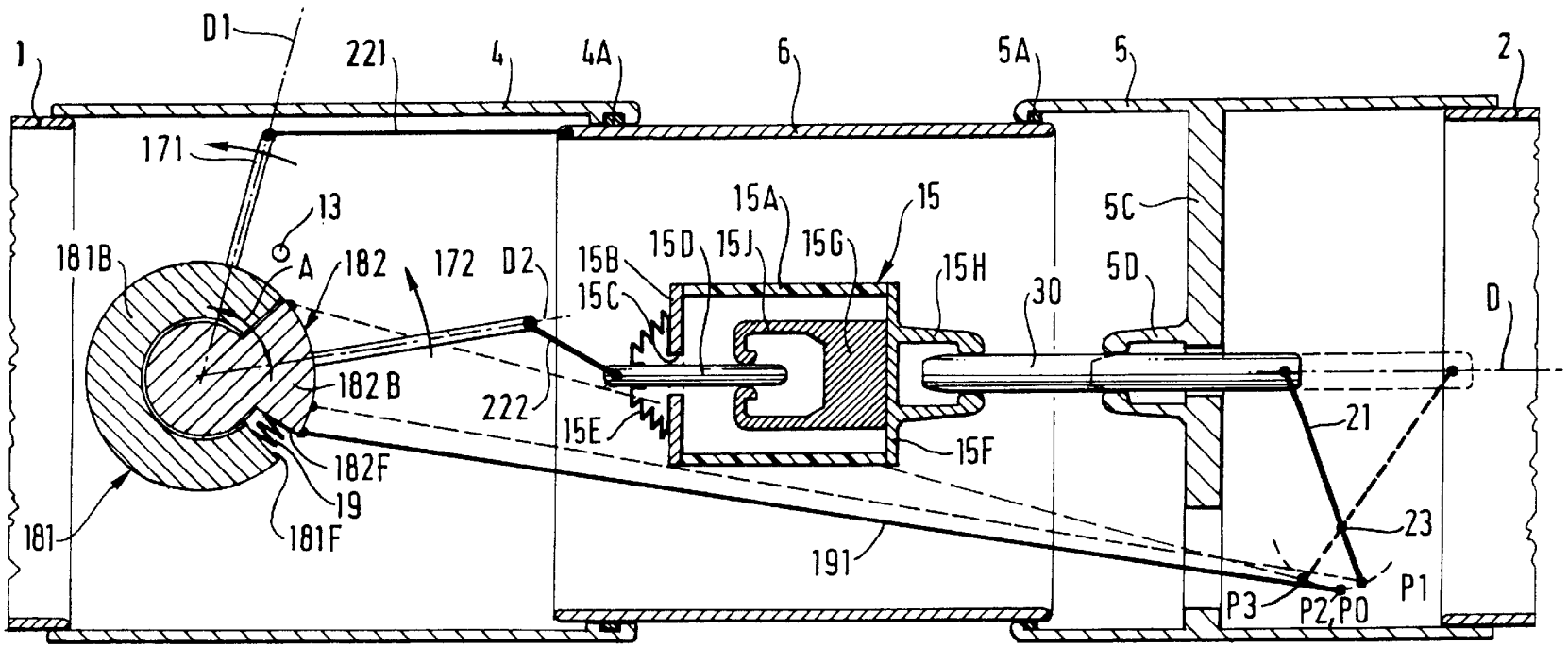
FIG. 1 is a diagrammatic view in longitudinal section through the circuit-breaker including a disconnector.

In FIG. 1, the circuit-breaker of the invention is inserted between the portions 1 and 2 of a phase conductor of an electricity line. The portions 1 and 2 of the conductor are connected mechanically and electrically to stationary main contacts 4 and 5 of the circuit-breaker. These contacts co-operate with a moving main contact 6 mounted to move relative to the stationary main contacts in a longitudinal direction D. The fixed main contact 5 co-operates with the moving main contact 6 by means of a ring of contact fingers 5A. The stationary main contact 4 co-operates with the moving main contact 6 by means of a sliding contact 4A.

The stationary main contacts 4 and 5, and the moving main contact 6 are tubular in shape and they define an internal volume in which a "bottle" 15 containing either a vacuum or else sulfur hexafluoride $SF_6$ is disposed. The bottle comprises a cylindrical insulating casing 15A having a metal end wall 15B provided with a hole 15C through which a moving arcing contact 15D slides. The bottle is held stationary in the volume by arms (not shown) that are fixed to the end wall 15B. The bottle is made gastight at the hole by means of a bellows 15E.

Since the vacuum or the gas is confined to the bottle, the pressure in the volume defined by the main contacts is preferably equal to the air pressure.

The bottle is closed at the end opposite from the end wall 15B by a metal end wall 15F carrying a stationary arcing contact 15G mounted inside the bottle, and a ring of metal contact fingers 15H mounted outside the bottle. At one of its ends, the stationary arcing contact 15G is provided with a hollow cylinder 15J inside which the moving arcing contact 15D slides.

Figure 2:
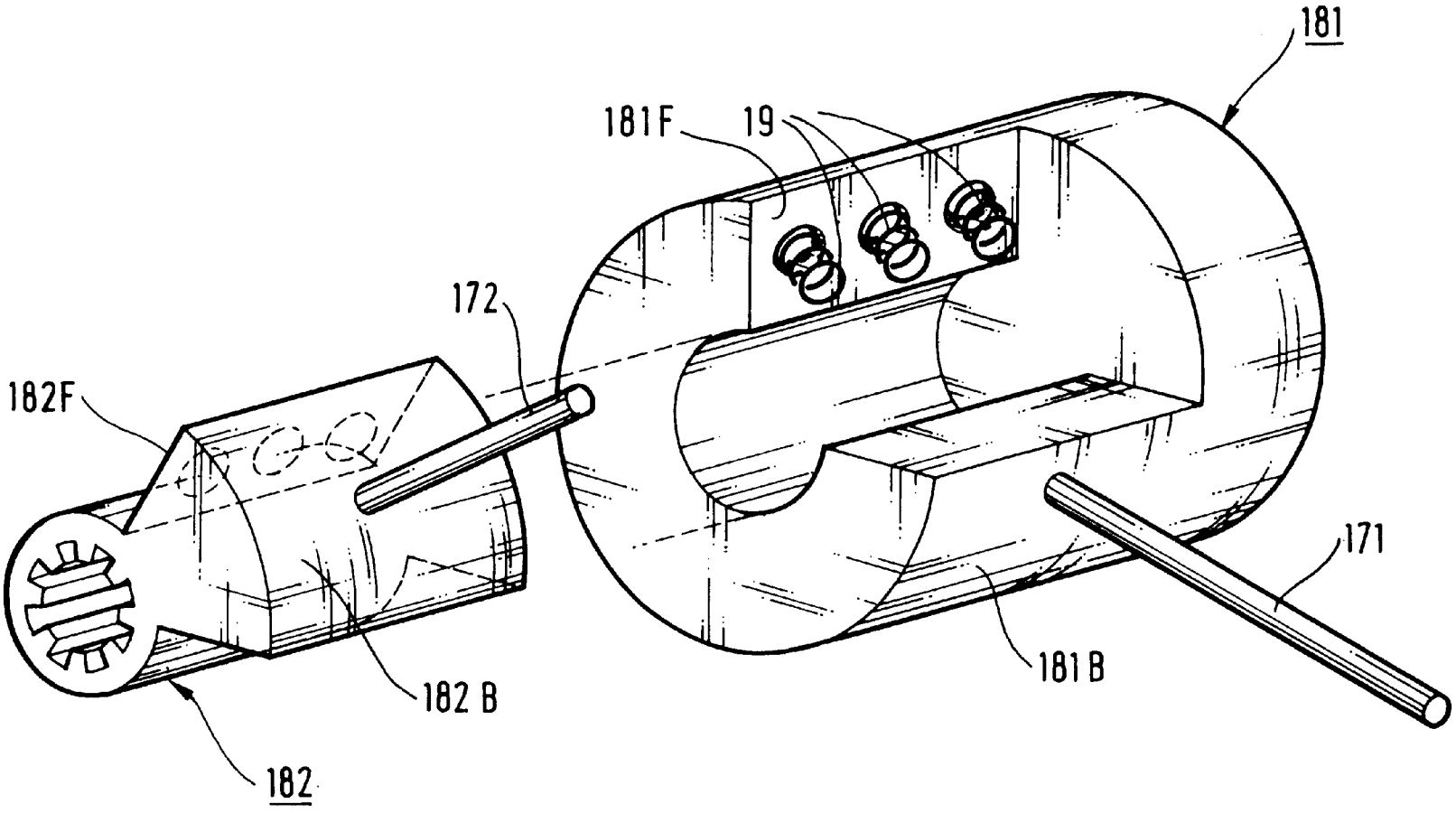
FIG. 2 is a diagrammatic perspective view showing the shaft and the hub of the circuit-breaker.

As shown in FIG. 2, a shaft 181 extending transversely to the longitudinal direction D and mounted with an internal hub 182 is disposed in the volume of the stationary main contact 4. The shaft and the hub are shaped over a portion B into two coaxial sectors 181B and 182B, the sector 181B being integral with the shaft and having an arc of 270 degrees, for example, and the sector 182B being integral with the hub and having an arc of 70 degrees, for example. The two sectors have respective facing faces 181F and 182F forming an arc of 20 degrees between them and interconnected by a spring 19.

The shaft 181 carries a first lever 171 secured to the moving main contact 6 by means of a rigid rod 221. The hub 182 carries a second lever 172 that is secured to the moving arcing contact 15D by means of a rigid rod 222. The two levers form an angle of 65 degrees, for example, in a plane extending transversely to the shaft 181. The lever 172 is longer than the lever 171, e.g. in a ratio of 1.75.

The circuit-breaker operates as follows.

Single control means (not shown) rotate the shaft 181, e.g. at constant speed. The total angle of rotation of the shaft 181, e.g. equal to 60 degrees, is the sum of three angles, each of which corresponds to a circuit-breaker opening stage.

In the initial state, the circuit-breaker is closed. A first opening stage is implemented by rotating the shaft 181 through a first angle $\alpha 1$, thereby causing the moving main contact 6 to move in translation via the lever 171 and the rigid rod 221. At the same time, the stiffness constant of the spring 19 is such that rotating the shaft 181 causes the hub 182 to rotate through a substantially equal angle. By rotating, the hub moves the moving arcing contact 15D in translation via the lever 172 and the rigid rod 222.

The angle $\alpha 1$, e.g. equal to 15 degrees, is chosen firstly to enable the moving main contact 6 to travel over a relatively long stroke so as to separate it from the fixed main contact 5 by a distance that is long enough to withstand a transient voltage, and secondly to enable the moving arcing contact 15D to travel over a relatively short stroke so as to keep it in contact with the fixed arcing contact 15G via the cylinder 15J.

Figure 3A:
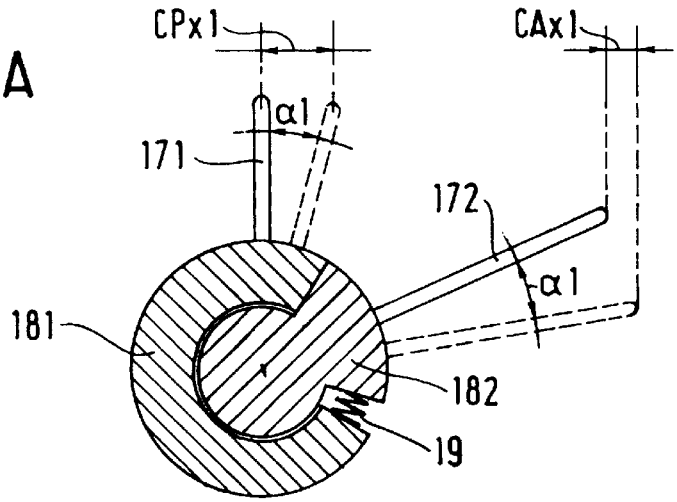
FIGS. 3A to 3C show an example of how the moving main contact and the moving arcing contact of the circuit-breaker are synchronized.
Figure 3B:
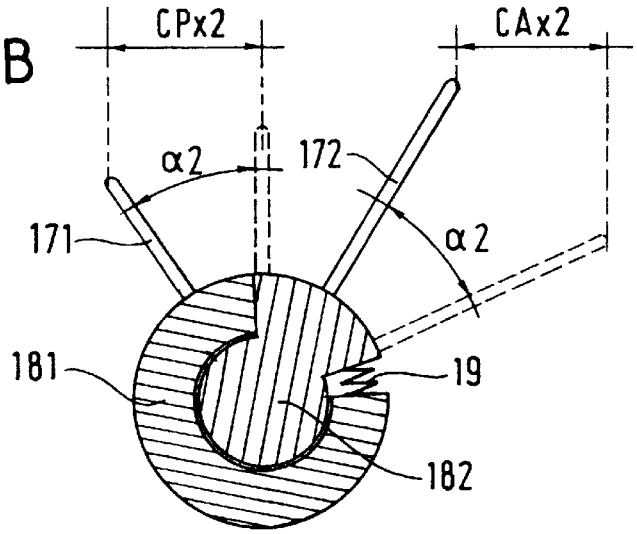
Figure 3C:
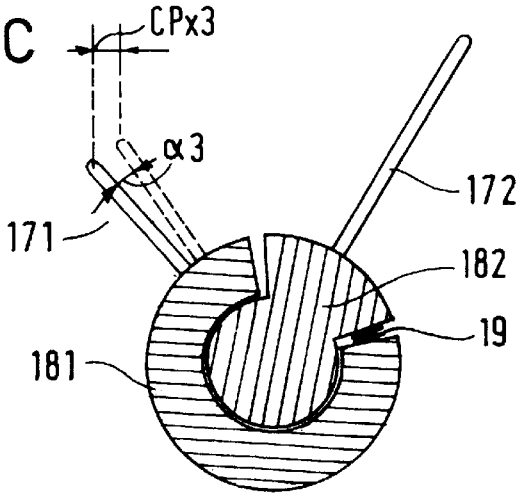

FIGS. 3A to 3C show the stroke of the moving main contact 6 (CPx) and the stroke of the moving arcing contact 15D (CAx) as a function of the angle of rotation of the shaft 181, for the above-mentioned values given by way of example (angle between the lever 171 and the lever 172 equal to 65 degrees, ratio of lengths of the levers equal to 1.75). FIG. 3A shows the rotation through angle $\alpha 1$ after which the stroke CPx1 of the moving main contact 6 is greater than the stroke CAx1 of the moving arcing contact 15D.

Similarly, the difference in the stroke lengths of the moving main contact 6 and of the moving arcing contact 15D is controlled by the angle A formed by the levers 171 and 172 in a plane extending transversely to the shaft 181, and by the ratio of the lengths of the levers.

As shown in FIG. 3B, a second circuit-breaker opening stage is implemented by rotating the shaft 181 through a second angle $\alpha 2$. The spring 19 rotates the hub 182 through a substantially equal angle as above.

The angle $\alpha 2$, e.g. equal to 34 degrees, is chosen to enable the moving arcing contact 15D to travel over a full stroke CAx1+CAx2 at the end of which the distance that separates it from the fixed arcing contact 15G is long enough to be able to withstand a dielectric voltage in the bottle containing a vacuum or sulfur hexafluoride $SF_6$. This full stroke corresponds to the distance between the cylinder 15J and the end wall 15B of the bottle.

During this second stage, the moving main contact 6 extends its separation stroke at the end of which it has travelled over a full stroke CPx1+CPx1, which is equivalent to the full stroke CAx1+CAx2 of the moving arcing contact 6. The two strokes are equivalent because the speed of the movement in translation of the moving arcing contact 15D has become greater than the speed of the moving main contact 6 during the rotation through the angle $\alpha 2$.

The relatively high speed of the moving arcing contact 15D makes it possible to open the circuit-breaker rapidly without overexposing the arcing contacts to the cutoff current, and also makes it possible to blast the $SF_6$ gas more effectively onto an electric arc formed between the arcing contacts. The relatively low speed of the moving main contact 6, which is heavier and therefore has higher inertia, is also advantageous because it makes it possible to minimize the power required to control the shaft 181.

Since the dielectric strength distance in air is greater than the dielectric strength distance in a vacuum or in sulfur hexafluoride, the moving main contact 6 travels along an overrun relative to the moving arcing contact 15D in a third stage. As shown in FIG. 3C, this overrun is implemented by the shaft 181 rotating through a third angle $\alpha 3$, e.g. equal to 11 degrees. Since the hub 182 is prevented from rotating by an abutment 13 mounted to be stationary in the volume of the circuit-breaker or on the moving arcing contact 15D, the spring 19 is compressed to enable the shaft 181 to rotate through $\alpha 3$, and to enable the rotation to be damped at the end of circuit-breaker opening. In this way, the end of the stroke of the moving main contact 6 corresponds to a long enough dielectric strength distance in air.

The vacuum bottle 15 is electrically connected in series with a disconnector comprising a moving contact 30 co-operating at a first end with the ring of fingers 15H. The moving contact 30 is a rod passing through a disk 5C integrally machined with the tube 5. The disk carries a ring 5D of electrical contact fingers for electrically connecting the rod 30 to the tube 5.

The other end of the contact rod 30 is hinged to a first link 21 mounted to rotate about an axis 23 that is perpendicular to the midplane of the circuit-breaker, represented by the plane of FIG. 1. A second link 191 connects one end of the link 21 to the shaft 181.

By means of the single control means for controlling the shaft 181, the links 21 and 191 make it possible to move and to synchronize the contact rod 30 of the disconnector relative to the moving contacts 6 and 15D of the circuit-breaker.

The disconnector operates as follows.

In the initial state, the disconnector is closed, in the position P0 shown in FIG. 1. During the first circuit-breaker opening stage, the shaft 181 rotating through an angle $\alpha 1$ causes the contact rod 30 to move towards the position P1, in which it remains in contact with the contact fingers 15H. Thus, the disconnector remains closed whereas the main contact 6 reaches a distance that is long enough to be able to withstand a transient voltage.

During the second opening stage, the shaft 181 rotating through an angle $\alpha 2$ causes the contact rod 30 to move in translation towards the position P2 which, in this example, is the same position as the position P0. The disconnector is closed, whereas the moving arcing contact 15D reaches the sufficient dielectric strength distance that corresponds to its full stroke.

During the third opening stage, the shaft 181 rotating through an angle $\alpha 3$ causes the contact rod 30 to move in translation towards the position P3 which opens the disconnector. The full stroke of the contact rod 30 corresponds to the sufficient dielectric strength distance in air.

The movement of the contact rod 30 is synchronized relative to the moving contacts merely by the shaft co-operating with the links, making it possible to open the disconnector firstly once the moving main contact has travelled over a long enough stroke to be able to withstand a transient voltage, and secondly once the moving arcing contact has travelled over a stroke that is long enough for dielectric strength purposes in the vacuum or the gas in the bottle.

We claim:

1. A generator circuit-breaker, comprising:

a first stationary tubular main contact;

a second stationary tubular main contact;

a moving tubular main contact mounted to move relative to the first and second stationary tubular main contacts in a longitudinal direction;

a bottle containing one of a vacuum and gas;

wherein the first and second stationary tubular main contacts and the moving tubular main contact define an internal volume inside which the bottle is disposed with a stationary arcing contact;

a moving arcing contact mounted to move relative to the stationary arcing contact in said longitudinal direction;

a shaft extending transversely to the longitudinal direction and carrying a first lever connected to the moving tubular main contact;

synchronization means ensuring that the second stationary tubular main contact and the moving tubular main contact separate before the moving arcing contact and the stationary arcing contact separate;

wherein the synchronization means comprise a hub which is mounted inside the shaft and which carries a second lever connected to the moving arcing contact, the shaft and the hub being shaped over a certain portion into two sectors between which a spring is disposed, the levers forming an angle in a plane extending transversely to the shaft, the shaft firstly rotating to an initial extent, thereby moving the moving tubular main contact and rotating the hub via the spring, the hub thereby moving the moving arcing contact.

2. A circuit-breaker according to claim 1, further comprising:

a disconnector having a moving contact rod mounted to move in said longitudinal direction relative to a ring of contact fingers that are secured to the bottle;

wherein the moving contact rod is connected to the shaft via a linkage.

3. A generator circuit-breaker, comprising:

a first stationary tubular main contact;

a second stationary tubular main contact;

a moving tubular main contact mounted to move relative to the first and second stationary tubular main contacts in a longitudinal direction;

a stationary arcing contact;

a moving arcing contact mounted to move relative to the stationary arcing contact in said longitudinal direction;

a bottle adapted for receiving said moving arcing contact and said stationary arcing contact;

a shaft extending transversely to the longitudinal direction and carrying a first lever connected to the moving tubular main contact;

a hub which is mounted inside the shaft and which carries a second lever connected to the moving arcing contact;

wherein the shaft and the hub are shaped over a certain portion into two sectors between which a spring is disposed, the levers forming an angle in a plane extending transversely to the shaft;

wherein the first lever moves the moving tubular main contact in conjunction with the second lever moving the moving arcing contact so that the moving arcing contact separates from the bottle after the moving tubular main contact separates with the second stationary tubular main contact.

4. A circuit-breaker according to claim 3, further comprising:

a disconnector having a moving contact rod mounted to move in said longitudinal direction relative to the bottle;

wherein the moving contact rod is connected to the shaft via a linkage.

* * * * *